US005411247A

United States Patent [19]

Ohsawa

[11] Patent Number: 5,411,247

[45] Date of Patent: May 2, 1995

[54] AUTOMATIC DOCUMENT FEEDER WITH SMOOTH SHEET FEEDING MECHANISM

[75] Inventor: Yukio Ohsawa, Yamanashi, Japan

[73] Assignee: Nisca Corporation, Yamanashi, Japan

[21] Appl. No.: 160,095

[22] Filed: Dec. 1, 1993

[51] Int. Cl.[6] ..... B65H 3/00

[52] U.S. Cl. ..... 271/119; 271/121; 271/126; 271/245

[58] Field of Search ..... 271/119, 121, 124, 126, 271/245

[56] References Cited

U.S. PATENT DOCUMENTS

| | | | |
|---|---|---|---|
| 5,052,676 | 10/1991 | Shiima et al. | 271/121 |
| 5,083,766 | 1/1992 | Osawa | 271/126 |

FOREIGN PATENT DOCUMENTS

| | | | |
|---|---|---|---|
| 2332034 | 1/1975 | Germany | 271/124 |
| 3158329 | 7/1991 | Japan | 271/119 |
| 3162331 | 7/1991 | Japan | 271/119 |

*Primary Examiner*—H. Grant Skaggs
*Attorney, Agent, or Firm*—Kanesaka & Takeuchi

[57] ABSTRACT

An automatic document feeder is formed of a sheet mounting portion for receiving a sheet thereon, a rotating member located at the sheet mounting portion, and a pressure device situated at a side opposite to the rotating member. The rotating member rotatably contacts the sheet on the sheet mounting portion and transfers the sheet from the sheet mounting portion. The sheet is supplied onto the sheet mounting portion from an upstream side of a sheet transfer direction so that the sheet is located between the rotating member and the pressure device and is urged onto the rotating member by the pressure device. The feeder further includes a guide member partly covering the rotating member at the upstream side of the sheet transfer direction. The guide member guides the sheet on the sheet mounting portion from the upstream side to a downstream side thereof.

9 Claims, 4 Drawing Sheets

AUTOMATIC DOCUMENT FEEDER WITH SMOOTH SHEET FEEDING MECHANISM

BACKGROUND OF THE INVENTION AND RELATED ART STATEMENT

The present invention relates to an automatic document feeder for feeding a sheet or a manuscript onto a platen of a copy machine or an image reader, or for feeding a sheet to the copy machine.

In conventional automatic document feeders, one of the document feeders is provided with a sheet mounting portion, a roller rotationally contacting and transferring a sheet mounted on the sheet mounting portion, and a pressure device for urging the sheet located on the sheet mounting portion onto the roller. When sheets or manuscripts are supplied onto the sheet mounting portion, the sheets are fed into a space between the roller and the pressure device from an upstream side of the sheet transfer direction.

In case the roller is a semi-circular roller having a semi-circular portion and a non-circular or cutout portion in cross section, when a switch is actuated, an initial operation is made. In the initial operation, the semi-circular roller rotates such that the semi-circular portion is located under a guide plate at the sheet mounting portion and the cutout portion is located under the guide plate. As a result, the semi-circular roller is positioned in an initial condition where the semi-circular roller does not contact the sheet to be fed.

In the former case, when the sheets are mounted, the front edges of the sheets may abut against the roller projecting from the sheet mounting portion. Thus, the sheets may not properly set on the sheet mounting portion. Sometimes, the sheets are damaged.

In the later case, before the switch is initially turned on, the semi-circular roller may not be in the initial condition. Thus, when the sheets are mounted, the sheets may be damaged or may not be properly set, as in the former case.

Accordingly, one object of the invention is to provide a sheet feeding mechanism for an automatic document feeder, wherein when the sheets are supplied to a portion between the roller and the pressure device from an upstream side of the roller, the sheets do not abut against or hit the roller and the sheets can be smoothly set on the sheet mounting portion.

Another object of the invention is to provide a sheet feeding mechanism as stated above, wherein the sheets can be set reliably onto the sheet mounting portion without causing damage to the sheets.

A further object of the invention is to provide a sheet feeding mechanism as stated above, wherein a rotational power for an operation mechanism, e.g. the semi-circular roller, can be reduced.

Further objects and advantages of the invention will be apparent from the following description of the invention.

SUMMARY OF THE INVENTION

In the present invention, an automatic document feeder may be used for feeding sheets or documents onto a platen of a copy machine, or for supplying sheets to a copy machine to be copied thereon. The document feeder is basically formed of a sheet mounting portion for receiving sheets or documents thereon, a rotating member located at the sheet mounting portion, and a pressure device situated at a side opposite to the rotating member.

The sheets are supplied onto the sheet mounting portion from an upstream side of a sheet transfer direction to the rotating member so that the sheets are located between the rotating member and the pressure device and are urged onto the rotating member by the pressure device. The rotating member rotationally contacts lower or upper sheet on the sheet mounting portion and transfers the sheets from the sheet mounting portion.

In the present invention, a guide member is formed to partly cover the rotating member at the upstream side of the sheet transfer direction. The guide member guides the sheets on the sheet mounting portion from the upstream side to a downstream side thereof.

In case the rotating member is a semi-circular roller having a semi-circular portion and a non-circular or cutout portion, the guide member covers the upstream side thereof. Also, the guide member contacts the rotating member and pivots or tilts along an outer periphery of the rotating member. Thus, when the sheet is supplied to the sheet mounting portion, the sheet is properly guided and placed on the intended position.

In case the cutout portion includes an upstream side and a downstream side thereof, it is preferable to set the frictional coefficient at the downstream side less than that at the upstream side. Consequently, edges of the sheets can slide over the downstream side of the cutout portion, and the sheets can be properly set on the sheet mounting portion.

DETAILED DESCRIPTION OF THE PREFERRED EMBODIMENTS

As an embodiment for a document feeder of the invention, a document feeder for feeding a sheet or manuscript to an image forming machine, such as a copy machine, is explained herein below.

Figure 1:
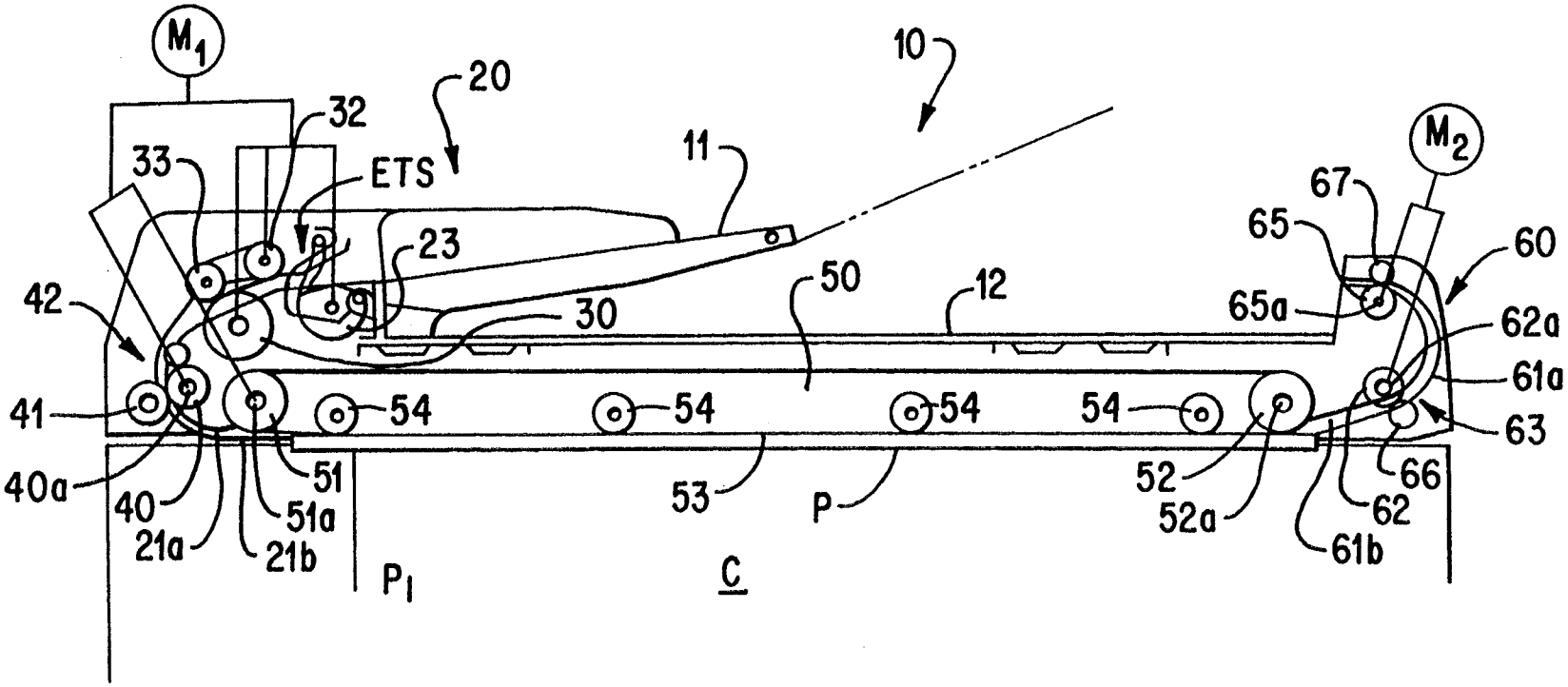
FIG. 1 is an explanatory cross section view of an automatic document feeder of the present invention.

As shown in FIG. 1, a document feeder 10 is formed of a tray 11 as a sheet mounting portion for mounting sheets, a sheet feeding portion 20 for separating the sheets on the tray 11 and feeding the sheet one by one, and a transfer portion 50 for receiving the sheet from the feeding portion 20 and transferring the sheet on a predetermined position on a platen P of an image forming machine C. The sheet on the platen P is exposed to light to make a copy.

The document feeder 10 further includes an ejecting portion 60 for ejecting the sheet after a copy is made, and an ejecting tray 12 for receiving the ejected sheet. Also, the feeder 10 includes a control device (not shown) for controlling the feeder.

Since the tray 11 is attached to the feeding potion 20, when the feeding portion 20 is referred to, the tray 11 is included hereinunder. In the feeder 10, the feeding portion 20 and the transfer portion 50 are actuated by a first motor M1, while the ejecting portion 60 is actuated by a second motor M2.

In the feeding portion 20, guide plates 21*a*, 21*b* for guiding the sheets are formed to extend from a downstream side of the tray 11 to an inlet of the transfer portion 50.

Figure 2:
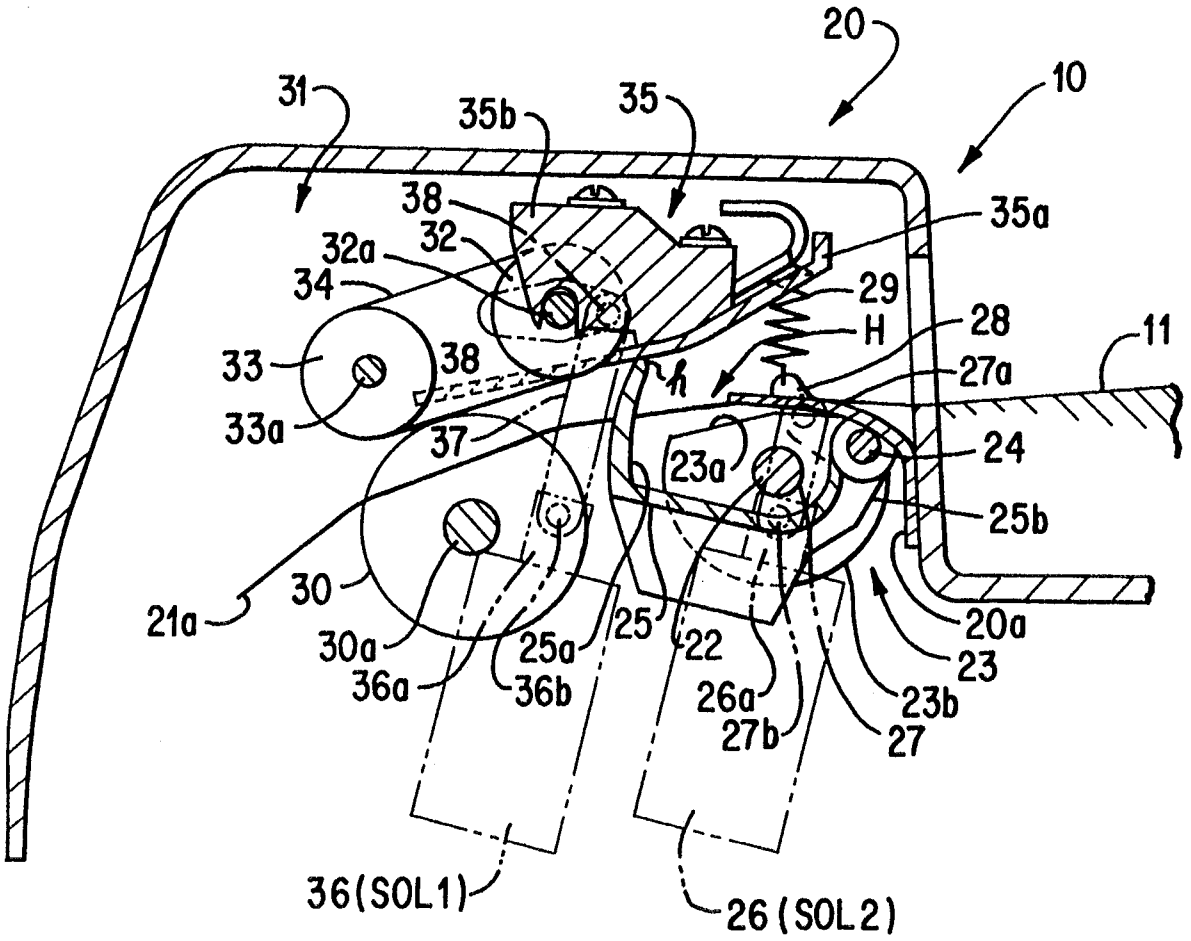
FIG. 2 is an enlarged section view of a sheet feeding portion of the document feeder of the invention.

As shown in FIG. 2, near the upper most portion of the guide plate 21*a*, a roller, such as a semi-circular roller 23 formed of a rubber, is provided. The semi-circular roller 23 includes a shaft 22 and is rotated through the shaft 22. The semi-circular roller 23 includes a semi-circular portion 23*b* and non-circular or cutout portions 23*a*, 23*c*. The surface of the non-circular portion 23*a* is coated with a paint so that friction coefficient of the outer surface of the non-circular portion 23*a* is less than that of the non-circular portion 23*c*.

Also, as shown in FIG. 2, an arm portion 25*b* is connected to a shaft 24, and a stopper 25 projecting through the guide plate 21*a* is attached to the arm portion 25*b*. In particular, the stopper includes pawls 25*a* extending through the guide plate 21*a* and restricting the front edges of the sheets. Also, the arm portion 25*b* is integrally connected to a lever 28.

The lever 28 is connected to a plunger 26a of a second solenoid 26 (SOL 2) through a connecting lever 27 with pins 27*a*, 27*b*. Further, the lever 28 is urged upwardly by a spring 29, by which the lever 28 is urged in a clockwise direction as shown in FIG. 2 when the solenoid 26 is not actuated. In this condition, the pawls 25*a* project through the guide plate 21*a* to thereby restrict or hold the front edges of the sheets.

Figure 4:
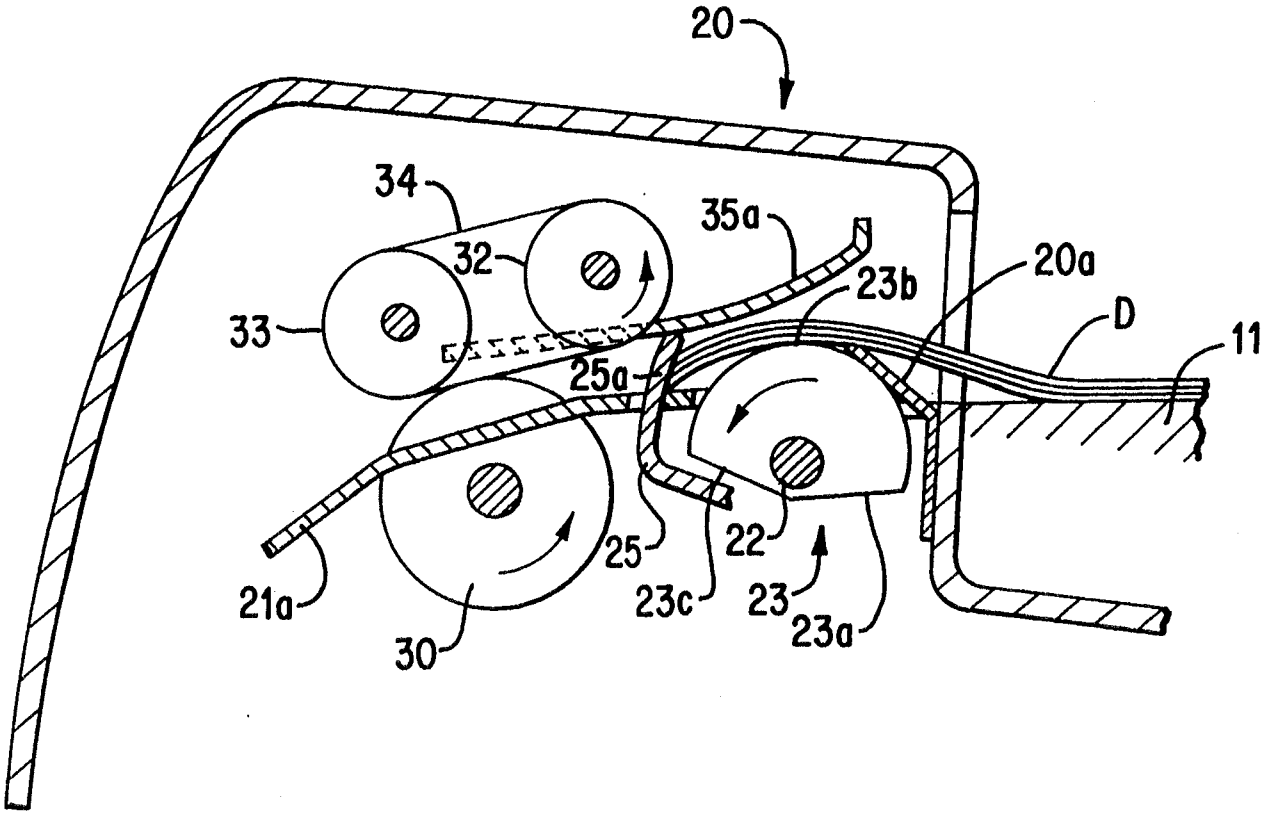

Further, as clearly shown in FIG. 4, a guide member 20*a* is formed to cover an upstream side of the semi-circular portion 23*b* of the semi-circular roller 23.

Figure 3:
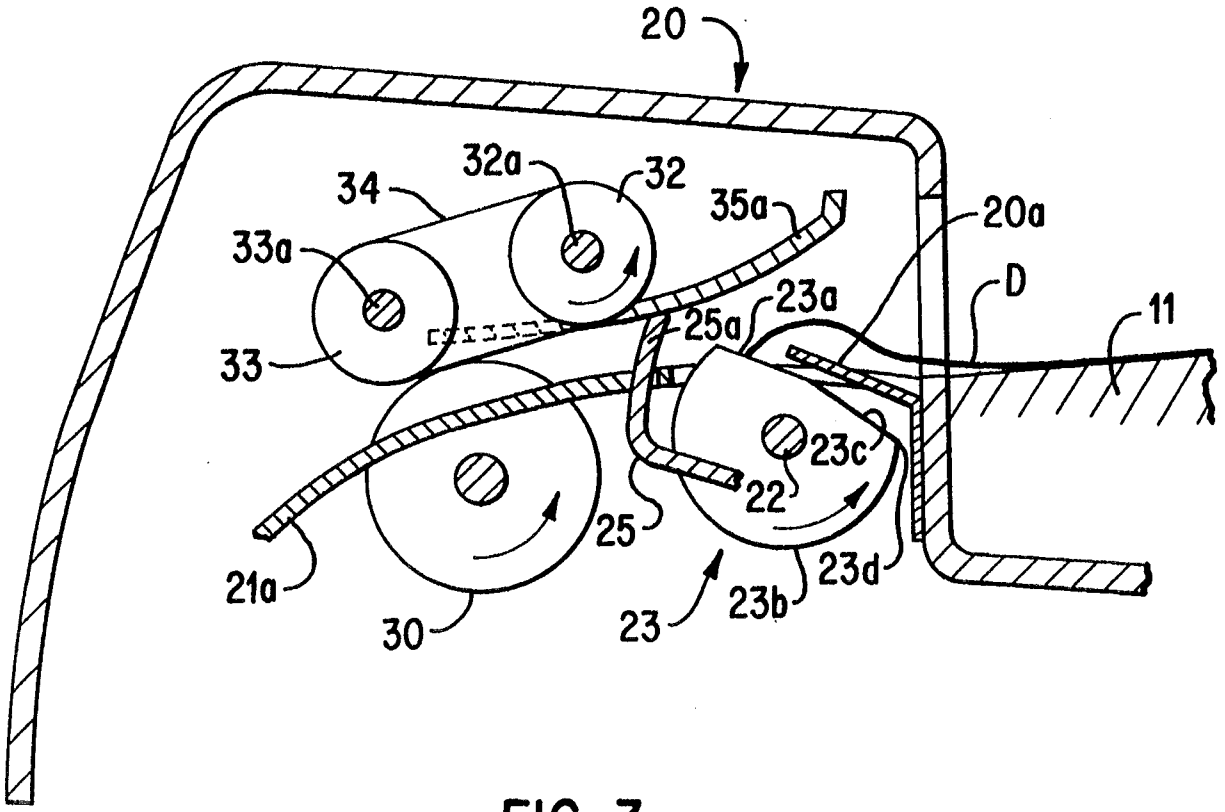
FIGS. 3 and 4 are section views for explaining the operation of the sheet feeding portion.

The guide member 20*a* is formed of a thin material having a smooth outer surface with elasticity, such as a resin sheet. The guide member 20*a* can bend along and contact the semi-circular portion 23*b* and non-circular portions 23*a*, 23*c* according to the rotation of the semi-circular roller 23, as shown in FIGS. 3 and 4. Thus, when the sheets are supplied from the tray 11, the sheets can be smoothly inserted into a space H explained later while the lower sheet does not stick to the semi-circular roller 23. The guide member 20*a* is fixed to a cover of the sheet feeding portion 20.

As shown in FIG. 2, a roller 30 is formed at a downstream side of the guide plate 21*a*. The roller 30 rotates together with a shaft 30*a* and operates to transfer the sheet.

At an upper portion of the roller 30, a separating device 31 formed of a pair of rollers 32, 33 and a separating belt 34 situated over the rollers 32, 33 are provided. The rollers 32, 33 are fixed to respective shafts 32a, 33a. The shaft 32a is an actuating shaft, which is rotated in a counter clockwise direction in FIG. 2, so that the sheets except for the lowermost sheet are transferred back to the upstream side by the belt 34.

A pressure device, such as a sheet pressing member 35, which contacts an uppermost sheet and presses the sheets to the semi-circular roller 23, is pivotally supported on the shaft 32*a*. The sheet pressing member 35 is formed of a pressing portion 35*a* contacting the sheet, and a weight portion 35*b* for providing pressure by its own weight.

A first solenoid (SOL 1) 36 is attached to the pressing member 35 to apply pressure thereto more than the weight portion 35*b*. A plunger 36*a* of the solenoid 36 is connected to the weight portion 35*b* through a connecting lever 37 and pins 36*b*, 38.

Accordingly, when the solenoids SOL 1, SOL 2 are not actuated, the pawls 25*a* project upwardly through the guide plate 21*a* by the spring 29 attached to the lever 28, while the upper edges of the pawls 25*a* engage the pressing portion 35*a* of the sheet pressing member 35 and push the pressing member 35 upwardly.

As shown in FIG. 2, a sheet setting space H is defined by the upper surface of the guide plate 21*a*, the front side of the pawls 25*a* and the lower surface of the pressing portion 35*a*. The sheets set in the space H do not pass toward the downstream side, because the upper edges of the pawls 25*a* abut against the lower surface of the pressing portion strongly at an abutting portion h. Also, as shown in FIG. 1, an empty sensor ETS for sensing presence or absence of the sheet is formed in the space H.

When the plunger 26*a* is pulled by actuating the solenoid SOL 2, the stopper 25 rotates in the counter clockwise direction in FIG. 2, so that the pawls 25*a* are withdrawn downwardly from the surface of the guide plate 21*a*. As a result, the sheet pressing member 35 rotates by its own weight in the clockwise direction, and the pressing portion 35*a* pushes the upper surface of the sheets.

As shown in FIG. 1, a register sensor 42, a register roller 40 and a register pinch roller 41 urged against the register roller 40 are formed at the downstream side of the roller 30. The register sensor 42 operates to set a timing of the sheet transferred along the guide plates 21*a*, 21*b*. The register roller operates to adjust the posture of the sheet and set the sheet feed timing.

The transfer portion 50 is formed of a pair of belt rollers 51, 52 supported on side plates of the feeding device 10, and a transfer belt 53 situated over the belt rollers 51, 52. Also, a plurality of pressing rollers 54 is disposed between the belt rollers 51, 52.

Incidentally, the motor M1 actuates in its forward rotation the semi-circular roller 23 and rollers 30, 32, and in its reverse rotation the register roller 40 and belt roller 51.

The ejecting portion 60 includes ejecting guides 61*a*, 61*b* which curve from an outlet of the transfer portion 50 and change the direction of the sheet about 180 degrees. From a portion near the transfer portion 50, a roller 62 fixed to a shaft 62*a*, a pinch roller 66 and an ejecting sensor 63 are formed along the ejecting guides 61*a*, 61*b*. Also, an ejecting roller 65 and a pinch roller 67 are formed near an outlet of the ejecting portion 60.

In the control device (not shown), a CPU is included, wherein a predetermined calculation is made while receiving signals from the empty sensor ETS, register sensor 42, ejecting sensor 63 and so on. Upon receipt of the calculation result and signals from the image forming device C, the CPU also operates to actuate the motor M1, M2, solenoids SOL 1, SOL 2 and so on, and to transfer the control results to the image forming device C.

When the automatic document feeder 10 is actuated, the sheets D are placed onto the tray 11, and inserted into the space H. At this time, as shown in FIG. 4, even if the semi-circular portion 23*b* of the semi-circular roller 23 projects from the guide plate 21*a*, the sheets D are guided by the guide member 20*a* covering the upstream side of the semi-circular roller 23 and are smoothly set in the space H without hitting or sticking to the roller 23.

Also, as shown in FIG. 3, even if the non-circular portion 23*a* projects upwardly through the guide plate 21*a* and the forward edge of the sheet D is curled as shown in the drawing, since the outer surface of the non-circular portion is finished to have low frictional coefficient, the curled forward edge can be transferred smoothly while sliding over the non-circular portion 23*a*.

When the sheets are set on the tray 11, the empty sensor ETS turns on to complete the preparation of the feeding of the sheets.

At this stage, when a copy button of the image forming device C is pushed, the sheet feeding operation starts and the motor M1 rotates in the forward direction, by which the semi-circular roller 23 and the rollers 32, 30 are actuated.

When the semi-circular roller is actuated, the semi-circular roller 23 rotates in the counter clockwise direction. In case the semi-circular roller is in the condition as shown in FIG. 3, the guide member 20*a* is pushed upwardly by an edge 23*d* of the non-circular portion 23*c*. In the condition as shown in FIG. 4, since the sheets D contact the semi-circular portion 23*b*, the sheets D are urged to move forwardly. However, since the stopper 25 is not withdrawn, the sheets D are not transferred and are moved up and down in that position. In this operation, air is supplied to the spaces between the sheets, so that the sheets can be easily separated.

About 200 ms later from the operation of the motor M1, the solenoid SOL 2 is energized, by which the lever 28 is pulled, and the stopper 25 rotates in the counter clockwise direction. As a result, the sheet pressing member 35 urged upwardly by the pawls 25*a* falls downwardly by its own weight and lightly contacts the uppermost sheet. After 50 ms, the solenoid SOL 1 is actuated for 25 ms to increase the pressing force of the pressing member 35 for the sheets. As a result, whenever the sheets D contact the semi-circular portion 23*b*, the sheets D are surely transferred, and are separated one by one by the roller 30 and the belt 34. The separated sheet is further transferred.

After 10 ms from actuation of the register sensor 42, the motor M1 stops. As a result, the forward edge of the sheet hits a portion between the register roller 40 and the pinch roller 41 and is curled to adjust the posture of the sheet.

After 50 ms from the completion of the adjustment, the motor M1 is rotated in the reverse direction, by which the register roller 40 and the belt roller 51 are actuated. Thus, the sheet is transferred again, and at the same time, a counter for a sheet size is set. When the size is counted up together with the information of the sheet size, the information of the sheet size is obtained. Based on this information, the pulse number for stopping the sheet is set.

When the motor M1 rotates in the reverse direction, the belt roller 51 operates to transfer the sheet, and this movement is transferred to the belt roller 52. However, this movement is not transferred to the semi-circular roller 23 and the rollers 32 and 30 through one way clutches (not shown).

When the set pulse is counted up, the motor M1 stops, so that the sheet is stopped at a reference position P1 on the platen. The image forming device C operates to make a copy.

During copying, the motor M1 is rotated in the forward direction to set up the initial operation for the next sheets. After 50 ms, the solenoid SOL 1 is turned on to provide pulling force of the solenoid to the pressure member 35 for 25 ms, by which the next sheets are transferred forwardly. When the solenoid SOL 1 is turned off, the pressure member 35 has its own weight, at which the second sheet is separated and transferred further.

Thereafter, the register senor 42 is turned on, and after 10 ms, the motor M1 stops to adjust the posture of the sheet.

When the copy is completed, the motor M1 is rotated in the reverse direction, and the motor M2 is rotated in the forward direction. Thus, the next sheet is transferred onto the platen P, and the first sheet is transferred to the ejecting portion 60. The sheet transferred to the ejecting portion 60 is ejected to the tray 12 through the outlet. Also, the next sheet transferred onto the platen is copied. This procedure continues until the sheets on the tray 11 become empty.

In the present invention, the guide member 20*a* is provided to cover the upstream side of the semi-circular portion 23*b* of the semi-circular roller 23 in the sheet feeding direction, and to pivot or tilt along the outer periphery of the semi-circular roller 23 while contacting thereto when the semi-circular roller 23 is rotated, so that the sheets mounted on the tray 11 from the upstream side of the semi-circular roller 23 are guided to the downstream side of the semi-circular roller 23. Thus, the front edges of the sheets mounted on the tray 11 are guided onto the semi-circular roller 23 through the guide member 20*a*. Accordingly, the front edges of the sheets do not hit the semi-circular roller 23 to facilitate the setting of the sheets. Also, it is possible to prevent damage of the sheets, and the sheets can be surely fed to the feeder.

Further, the guide member 20*a* contacts and tilts along the outer periphery of the semi-circular portion 23*b* and non-circular portions 23*a*, 23*c* of the semi-circular roller 23 when the semi-circular roller rotates. If the guide member 20*a* is not provided, the non-circular portion 23*c* provides force onto the lower sheet in both upper and forward directions at the same time, so that the lower sheet suffers unduly treatment, and the semi-circular roller requires large operation force.

In the present invention, however, since the guide member 20*a* is provided, upward force is only applied to the lower sheet by the semi-circular roller 23. Also, since the lower sheet does not directly contact the non-circular portion 23*c*, the unduly force is not applied to the lower sheet, and therefore, the sheet is not damaged. Further, the semi-circular roller 23 requires less force for operation.

In addition, frictional coefficient on the surface of the downstream side of the non-circular portion is made less than that of the upstream side of the non-circular portion, so that even if the front edges of the sheets contact the downstream side of the non-circular portion, the front edges of the sheets slip over the downstream side of the non-circular portion. Thus, the sheets can be set properly to prevent damage for the sheets. The feeding mistake will be prevented, as well.

The present invention is not limited to the above embodiment, and it is possible to modify the invention further, for example as explained below.

(1) In the above embodiment, a paint is applied onto the surface of the non-circular portion 23*a* of the semi-circular roller 23 to reduce friction coefficient less than that on the non-circular portion 23*c*. However, it is possible to attach on the surface of the non-circular portion 23*a* a resin sheet to reduce friction coefficient less than that on the non-circular portion 23*c*.

(2) In the above embodiment, the roller has a semi-circular cross section, but it is possible to use a roller having a circular cross section.

(3) In the above embodiment, the guide member is made of a flexible non-metallic material, such as a resin sheet, but it is possible to form the guide member by a metal plate, such as a stainless plate.

(4) The guide member need not have flexibility. It is possible to make the guide member in the form of a solid plate with a hinge for tilting.

(5) In the above embodiment, the initial position of the semi-circular roller is not controlled. However, even if the initial position of the semi-circular roller is controlled, the guide member may be installed.

In Japanese Patent Publication No. 3-119271, ejected sheets are disposed on an ejection tray located under a feeding tray for feeding the sheets to reduce the space for the trays, as in the present invention. In the publication, in order to properly place the ejected sheets on the ejection tray, the speed for ejecting the sheets is reduced or stopped just before the front edges of the ejected sheets are located under the feeding tray. In case the present invention is applied to this ejection system, the sheets can be properly treated when the sheets are ejected as well as when the sheets are fed to the machine.

While the invention has been explained with reference to the specific embodiments of the invention, the explanation is illustrative and the invention is limited only by the appended claims.

What is claimed is:

1. An automatic document feeder for feeding a sheet, comprising:

a sheet mounting portion for receiving a sheet thereon, a rotating member located in the sheet mounting portion at a downstream side of a sheet transfer direction, said rotating member rotatably contacting the sheet in the sheet mounting portion and transferring the sheet from the sheet mounting portion, a pressure device situated at a side opposite to the rotating member, said sheet being supplied onto the sheet mounting portion from an upstream side of the sheet transfer direction so that the sheet is located between the rotating member and the pressure device and is urged onto the rotating member by the pressure device, and a guide member partly covering the rotating member at the upstream side of the sheet transfer direction, said guide member being located under the sheet and guiding the sheet on the sheet mounting portion from the upstream side to a downstream side thereof over the rotating member.

2. An automatic document feeder according to claim 1, wherein said guide member contacts the rotating member and pivots along a circumference of the rotating member.

3. An automatic document feeder according to claim 2, wherein said rotating member is a semi-circular roller having a semi-circular portion and a cutout portion.

4. An automatic document feeder according to claim 3, wherein said cutout portion includes an upstream side and a downstream side, frictional coefficient at the downstream side being less than that at the upstream side so that an edge of the sheet can slide over the downstream side of the cutout portion.

5. An automatic document feeder according to claim 4, wherein said guide member extends to cover the upstream side of the cutout portion when the upstream and downstream sides are located substantially parallel to the guide member.

6. An automatic document feeder according to claim 5, wherein said guide member has a smooth outer surface to guide the edge of the sheet along the guide member.

7. An automatic document feeder according to claim 6, further comprising a stopper situated near the rotating member at a downstream side of the rotating member, said stopper holding the sheet supplied on the sheet mounting portion.

8. An automatic document feeder according to claim 1, wherein said sheet mounting portion includes a tray for mounting the sheet thereon, said rotating member being situated near the tray, and said guide member being fixed to the tray and placed above the rotating member.

9. An automatic document feeder for feeding a sheet, comprising:

a sheet mounting portion for receiving a sheet thereon, a rotating member located in the sheet mounting portion, said rotating member rotatably contacting the sheet in the sheet mounting portion and transferring the sheet from the sheet mounting portion, said rotating member being a semi-circular roller having a semi-circular portion and a cutout portion, said cutout portion having an upstream side and a downstream side, frictional coefficient at the downstream side being less than that at the upstream side so that an edge of the sheet can slide over the downstream side of the cutout portion, a pressure device situated at a side opposite to the rotating member, said sheet being supplied onto the sheet mounting portion from an upstream side of a sheet transfer direction so that the sheet is located between the rotating member and the pressure device and is urged onto the rotating member by the pressure device, and a guide member partly covering the rotating member at the upstream side of the sheet transfer direction, said guide member contacting the rotating member and pivoting along a circumference of the rotating member to guide the sheet on the sheet mounting portion from the upstream side to a downstream side thereof.

* * * * *